US006178643B1

(12) United States Patent
Erbrick et al.

(10) Patent No.: US 6,178,643 B1
(45) Date of Patent: Jan. 30, 2001

(54) HAND-HELD RATCHET ACTION TOOL

(75) Inventors: Robert S. Erbrick, Doylestown, PA (US); Joseph E. Erbrick, Jr., Cape Coral, FL (US); Joseph Homacki, Kintnersville, PA (US)

(73) Assignee: Electroline Corporation, Pipersville, PA (US)

( * ) Notice: Under 35 U.S.C. 154(b), the term of this patent shall be extended for 0 days.

(21) Appl. No.: 09/349,579

(22) Filed: Jul. 8, 1999

(51) Int. Cl.[7] ..... B26B 15/00

(52) U.S. Cl. ..... 30/228; 30/92; 30/249; 30/250

(58) Field of Search ..... 30/92, 249, 250, 30/251, 193, 228, 500; 81/314

(56) References Cited

U.S. PATENT DOCUMENTS

| | | | | |
|---|---|---|---|---|
| 2,256,779 | | 9/1941 | McHenry | 30/228 |
| 3,025,599 | | 3/1962 | Sauers et al. | 30/228 |
| 3,358,541 | | 12/1967 | Frei | 30/228 |
| 4,176,450 | * | 12/1979 | Muromoto | 30/92 |
| 4,178,682 | * | 12/1979 | Sadauskas | 30/250 |
| 4,186,484 | * | 2/1980 | Tanaka | 30/92 |
| 4,677,748 | * | 7/1987 | Kobayashi | 30/250 |
| 4,747,212 | | 5/1988 | Cavdek | 30/92 |
| 4,899,445 | | 2/1990 | Erbrick et al. | 30/251 |
| 4,998,351 | | 3/1991 | Hartmeister | 30/228 |
| 5,184,404 | * | 2/1993 | Chen | 30/250 |
| 5,195,353 | | 3/1993 | Erbrick et al. | 72/410 |
| 5,231,763 | * | 8/1993 | Laux | 30/250 |
| 5,272,811 | | 12/1993 | Armand | 30/228 |
| 5,307,565 | | 5/1994 | Erbrick et al. | 30/251 |
| 5,454,754 | | 10/1995 | Baertlein | 30/228 |
| 5,642,566 | * | 7/1997 | Hirabayashi | 30/250 |
| 5,718,051 | * | 2/1998 | Huang | 30/250 |
| 5,755,293 | | 5/1998 | Bourke | 30/500 |

* cited by examiner

*Primary Examiner*—Hwei-Siu Payer
(74) *Attorney, Agent, or Firm*—Akin, Gump, Strauss, Hauer & Feld, L.L.P.

(57) ABSTRACT

A hand-held, ratchet action tool closes together a pair of jaws. A first jaw is fixed in position. A second jaw includes a plurality of ratchet teeth and is mounted to pivot with respect to the first jaw. The ratchet tool further includes a linkage of four links operatively coupled together and with a motorized drive mechanism. A first pawl is supported on one of the links so as to be engageable with the teeth of the second jaw. The linkage is configured to convert drive motion from the drive mechanism into oscillatory motion of the pawl along the teeth. The first pawl is arranged to drive the working face of the second jaw towards that of the first jaw during the oscillatory motion. A second pawl engages with the teeth to permit the first pawl to be ratcheted back and forth, closing the second jaw on the first jaw. A selector lever is provided to manually disengage the pawls and to permit reopening of the jaws. An inhibitor or stop is located on the second jaw in a position to rotate the selector lever to disengage the second pawl at the end of travel of the second jaw to prevent damage to the mechanism. The inhibitor can be shaped into a handle to support the tool and manually rotate the jaw. The tool can include a drive mechanism or the tool can be configured to be releasably and drivingly connected to a separate drive mechanism such as a conventional electric hand drill.

18 Claims, 5 Drawing Sheets

HAND-HELD RATCHET ACTION TOOL

BACKGROUND OF THE INVENTION

U.S. Pat. No. 4,899,445 discloses a ratchet action manually operated tool for cutting cable or otherwise bringing a pair of jaws together in a scissor action, which includes first and second jaws pivotally coupled together with a pair of actuating, pivotally coupled handles. The first jaw is mounted on the end of a first handle. The second jaw includes a plurality of ratchet teeth for receiving a pawl, which is mounted on a second link extending between the jaw pivot and an end of the second handle. The tool uses a ratcheting action of the pawl and ratchet teeth to close the first and second jaws with respect to each other by repeatedly moving the handles towards and away from each other.

U.S. Pat. No. 5,307,565 discloses another hand operated ratchet tool which includes first and second handles, which are pivotally coupled to each other at one end, and first and second jaws which are pivotally coupled to each other and to the first and second handles through a linkage assembly of three links. First and second pawls are mounted on pivots on the linkage assembly. The second jaw includes a plurality of ratchet teeth for receiving the pawls to rotate the linkage assembly in a direction which closes the adjoining working faces of the jaws when the first and second handles are reciprocated repeatedly toward and away from each other.

While these tools have provided significant improvements over other existing manually operated cable cutters and other ratchet action jaw equipped hand tools known at the time, further improvements to the performance of such tools would be valuable.

BRIEF SUMMARY OF THE INVENTION

In one aspect, the present invention is a hand-held ratchet action tool for moving a pair of jaws toward and away from each other. The hand-held ratchet tool comprises a first jaw and a second jaw which includes a plurality of ratchet teeth. The second jaw is mounted to pivot with respect to the first jaw. The ratchet tool further includes a linkage of four links operatively coupled together and with the first and second jaws, and a pawl which is supported on one of the four links so as to be engageable with the ratchet teeth of the second jaw. The linkage is configured to drive the pawl into oscillatory motion along the ratchet teeth. The pawl is arranged to drive the second jaw towards the first jaw during the oscillatory motion.

In yet another aspect, the present invention is a hand-held ratchet action tool for moving a pair of jaws toward and away from each other. The hand-held ratchet tool comprises a first jaw and a second jaw having a plurality of ratchet teeth. The ratchet tool further comprises linkage means which is operatively connected to the first jaw and to the second jaw for closing the first and second jaws, a pawl which is supported on the linkage means so as to be engageable with the ratchet teeth of the second jaw, and drive means which is operatively connected to the linkage means for driving the pawl in an oscillatory motion along the ratchet teeth. The pawl is arranged to drive the second jaw towards the first jaw during the oscillatory motion.

In yet another aspect, the present invention is a hand-held ratchet action tool for moving a pair of jaws toward and away from each other. The hand-held ratchet tool comprises a frame; an elongate handle which is fixedly attached to the frame; a first jaw which is mounted to the frame; a first link which has first and second opposing ends, the first end of the first link being pivotally coupled to the frame; a second link which has first and second opposing ends; a third link which has first and second opposing ends, the first end of the third link, the second end of the first link and the first end of the second link all being pivotally connected along a common, movable pivot axis; a fourth link which has first and second opposing ends, the first end of the fourth link being pivotally coupled to the second end of the third link; and a second jaw which includes a plurality of ratchet teeth for receiving a first pawl, the second end of the fourth link and the second jaw being pivotally connected along a common, immovable axis fixed with respect to the first jaw. The ratchet tool further comprises a first pawl which is pivotally mounted on the fourth link between the first and second ends of the fourth link, so as to be engageable with the ratchet teeth of the second jaw; a motorized drive mechanism attached to the frame, the motorized drive mechanism having an output; and a gear set which has an input and an output, the motorized drive mechanism output being drivingly connected to the gear set input. Additionally, the ratchet tool comprises an eccentric which is drivingly connected to the gear set output, the eccentric pivotally supporting the second end of the second link, the second link being drivingly connected to the first pawl so as to close the second jaw in a first direction with respect to the first jaw when the motorized drive mechanism is operated; a second pawl which is mounted on the frame so as to engage the ratchet teeth of the second jaw to prevent the second jaw from being driven in a second direction opposite the first direction when the first pawl is disengaged from the ratchet teeth; a selector which is operatively associated with the first and second pawls to selectively bias the first and second pawls out of engagement with the ratchet teeth of the second jaw; and at least one inhibitor which is mounted on at least one of the first and second jaws so as to limit the relative movement of the second jaw with respect to the first jaw.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings.

DETAILED DESCRIPTION OF THE INVENTION

Certain terminology is used in the following description for convenience only and is not limiting. The words "left", "right", "lower", and "upper" as used herein, correspond to the direction on the figure being referenced. The words "inwardly" and "outwardly" refer to directions toward and away from, respectively, the geometric center of the tool and/or designated parts thereof. The terminology includes the words above 20 specifically mentioned, derivatives thereof and words of similar import.

U.S. Pat. Nos. 4,899,445 and 5,307,565 are incorporated herein in their entirety as if fully set forth.

Figure 1:
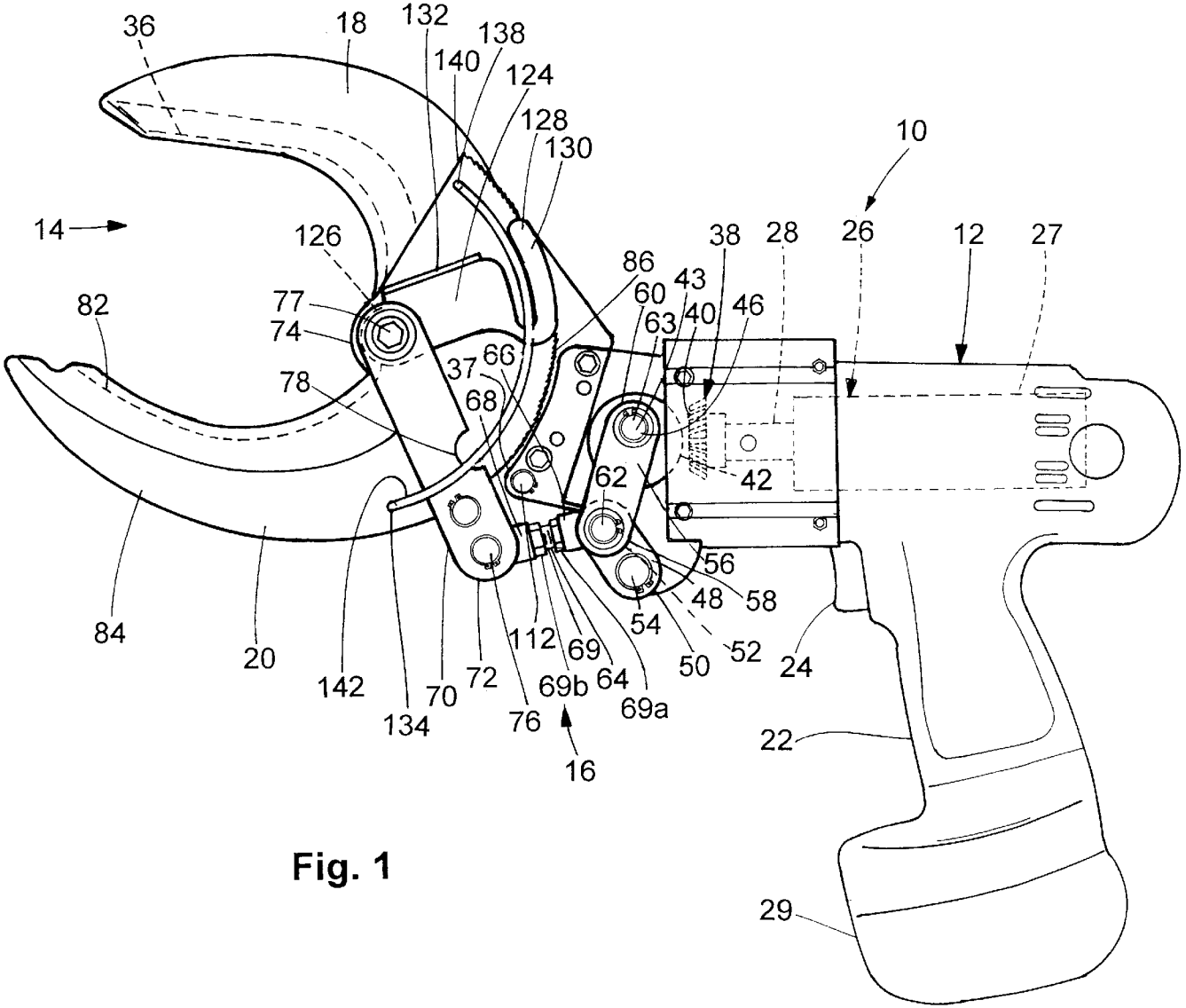
FIG. 1 is an elevational view of one major side of a motorized hand-held ratchet tool according to a first embodiment the present invention showing first and second jaws open.
Figure 2:
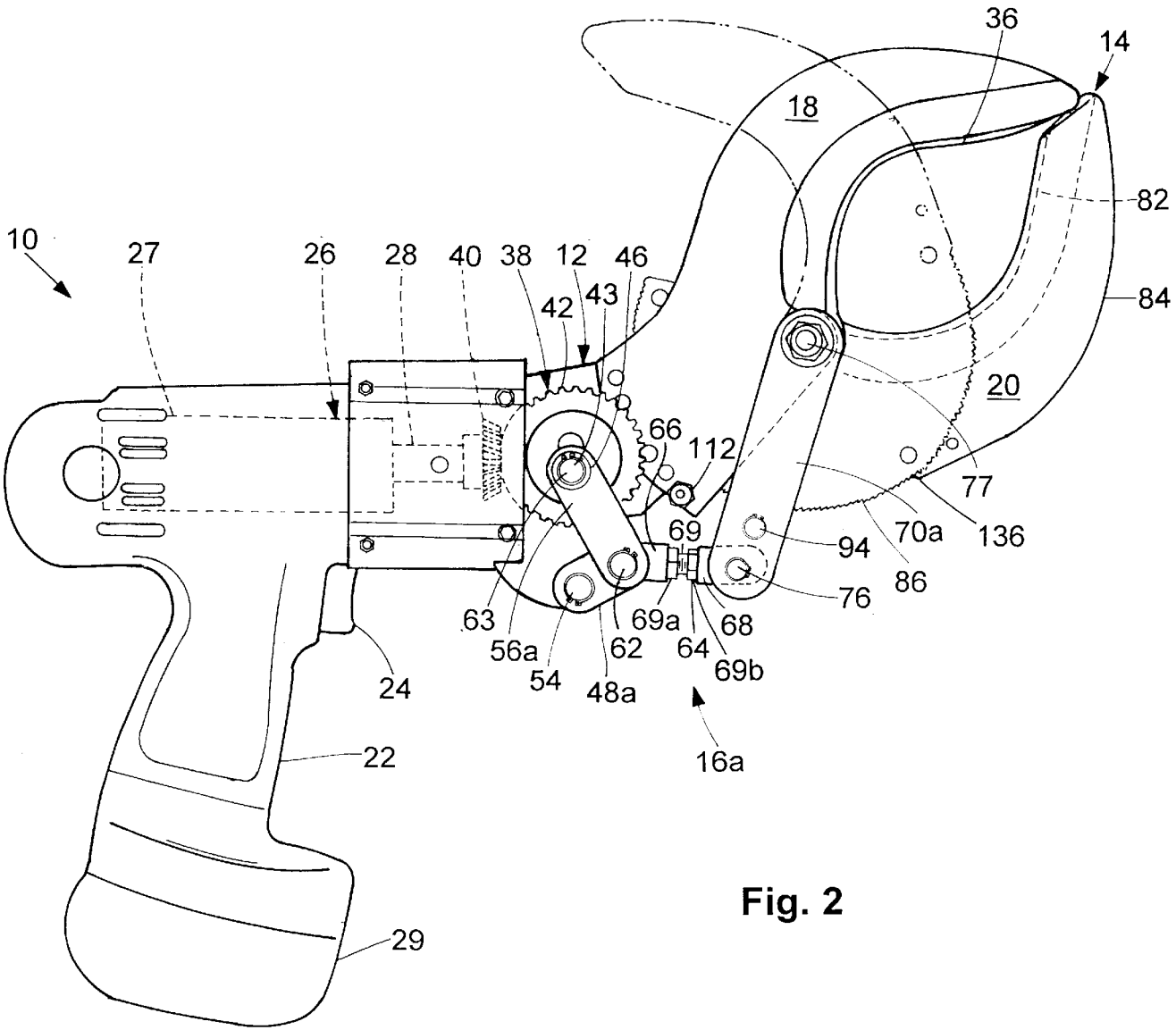
FIG. 2 is an elevational view of the opposing major side of the motorized hand-held ratchet tool according to the first embodiment of the present invention showing first and second jaws closed.

In the drawings, like numerals are used to indicate like elements throughout. A first preferred embodiment of a hand-held ratchet action tool or simply "ratchet tool" 10 for moving a pair of jaws toward and away from each other of the present invention is shown in FIGS. 1 and 2. The ratchet tool 10 is generally used to cut cables (not shown) or other items that are inserted between the jaws. The ratchet tool 10 includes a frame, indicated generally at 12, a jaw assembly, generally indicated at 14, which includes a first jaw 18 and a second jaw 20, and a first linkage assembly, generally indicated at 16, for driving the second jaw 20 toward the first jaw 18. FIG. 1 shows the first and second jaws 18, 20 open with respect to each other. FIG. 2 shows the first and second jaws 18, 20 partially closed with respect to each other in solid and fully closed in phantom.

Still referring to FIGS. 1 and 2, a first elongate handle 22 is fixedly attached to the frame 12. Preferably, the first elongate handle 22 is in the form of a pistol grip which extends generally downwardly from the frame 12. A trigger 24 is operatively connected to a manually powered, preferably motorized drive mechanism, generally indicated at 26 (in phantom), which is attached to the frame 12. The motorized drive mechanism 26 includes an electric motor 27 (in phantom) which is located inside the frame 12. The trigger 24 can be moved between "ON" and "OFF" positions to operate the electric motor 27. The motorized drive mechanism 26 further includes an elongate drive member in the form of an output shaft 28 (in phantom) which is operatively connected to the second jaw 20 so as to close the first and second jaws 18, 20, as will be more fully described herein.

The electric motor 27 is preferably a type of motor which is well known in the art. For example, the electric motor 27 may be a ¾ horsepower variable speed electric motor, having rotational speeds between 0 and about 1300 RPM often used in hand drills, although those skilled in the art will realize that other horsepowers and speeds can be used. Indeed, the frame 12 can be provided as a member or assembly fixedly mounted on a conventional electric hand drill. The electric motor 27 can operate at variable speeds which can be directly proportional to the distance that the trigger 24 is biased toward the first elongate handle 22. Preferably, the electric motor 27 can be powered by a rechargeable battery power supply 29, well known in the art, which may be located at the bottom of or in the first elongate handle 22, for remote operation. Alternatively, the ratchet tool 10 can be powered by 110 volt electrical alternating current supplied by a power cord (not shown) which is electrically connected to the electric motor 27.

Although not shown, a second elongate handle can be fixedly attached to the frame 12, preferably forward of the first elongate handle 22. A handgrip can be provided on the second elongate handle to provide better gripping capability for the operator. If used, the second elongate handle is spaced sufficiently from the first elongate handle 22 for the operator to comfortably grip the ratchet tool 10, using one hand (not shown) on each elongate handle. However, those skilled in the art will realize that the second handle can be eliminated entirely from the tool 10 without decreasing the performance capability of the tool 10.

As shown in FIGS. 1 and 2, the first jaw 18 is fixed with the frame 12, and extends generally from the frame 12. The first jaw 18 can be integral with the frame 12 or the first jaw 18 can be fixed to the frame 12 by mechanical means such as screws, nuts and bolts, rivets, and/or other mechanical fasteners known by those skilled in the art. The first jaw 18 includes a working face preferably in the form of a generally concave shaped beveled cutting blade 36 which extends around part of the perimeter of the first jaw 18, generally opposing a generally concave shaped beveled cutting blade 82 of the second jaw 20. Preferably, the cutting blade 36 is located on a major side of the first jaw 18 which faces the second jaw 20, as shown in FIG. 2. The frame 12 also includes a tang 37 proximate to the second jaw 20 for reasons that will become apparent.

The second jaw 20 includes a working face also preferably in the form of the generally concave shaped beveled cutting blade 82 which extends around part of the perimeter 84 of the second jaw 20, generally opposing the generally concave shaped beveled cutting blade 36 of the first jaw 18. Preferably, the cutting blade 82 is located on a major side of the second jaw 20 which faces the first jaw 18, as shown in FIG. 1. The cutting blades 36, 82 of the first and second jaws 18, 20, respectively, are located relative to each other to scissor side by side. A plurality of ratchet teeth 86 for receiving a first pawl 88 preferably are located on part of the perimeter 84 of the second jaw 20, generally distal from the cutting blade 82. The ratchet teeth 86 extend in an arc of approximately one hundred and fifty (150) degrees around the perimeter 84 of the second jaw 20, although those skilled in the art will realize that the ratchet teeth 86 can extend more or less than one hundred and fifty (150) degrees around the perimeter 84 of the second jaw.

Still referring to FIGS. 1 and 2, the motorized drive mechanism 26 preferably further includes a gear set, generally indicated at 38. The gear set 38 preferably includes an input bevel pinion 40 and an output bevel gear 42. The output shaft 28 is drivingly connected to the bevel pinion 40. The bevel pinion 40 is drivingly connected to the bevel gear 42. As shown in FIG. 2, the bevel gear 42 is mounted on a major side of the ratchet tool 10 with inwardly facing teeth. However, those skilled in the art will realize that the bevel gear 42 can be mounted on the opposing major side of the ratchet tool 10. The bevel pinion 40 rotates on the output shaft 28 of the electric motor 27 and the bevel gear 42 rotates on an axis 43 perpendicular to and intersecting the output shaft 28. The bevel gear 42 thus provides an output at a ninety degree angle to the input to the bevel pinion 40. Preferably, the bevel pinion 40 has fourteen (14) teeth and the bevel gear 42 has thirty-two (32) teeth, although those skilled in the art will realize that other numbers of teeth for the bevel pinion 40 and the bevel gear 42 can be used. Preferably, the bevel gear 42 reduces the rotational speed of the output from the bevel pinion 40. Although a preferred gear set 38 is a bevel gear set, those skilled in the art will realize that a worn gear set, a hypoid gear set, and other types of rotary couplings capable of transmitting power between axes at ninety degree angles to each other with the necessary reduction and without slippage can be used. An eccentric 46 is provided by a shaft eccentrically positioned through gear 42 and provides the rotary output of the gear set 38 to the remainder of the tool. In FIG. 1, the eccentric 46 is shown in an extreme upper which, for convenience, will be referred to hereafter as a "twelve o'clock" position.

Referring now to FIG. 1 only, the linkage assembly 16 will now be discussed. The linkage assembly 16 comprises four links operatively coupled together and with the drive mechanism 26 and at least the second jaw 20. A first link 48 has first and second opposing ends 50, 52, respectively. The first end 50 of the first link 48 is pivotally coupled to the frame 12 along a fixed position with respect to the first jaw 18 at a first pivot 54.

A second link 56 has first and second opposing ends 58, 60, respectively. The first end 58 of the second link 56 is pivotally coupled to the second end 52 of the first link 48 at a second pivot 62. The second end 60 of the second link 56 is pivotally connected to the drive mechanism 26 through the eccentric 46 on the gear set 38 which defines a third pivot 63 having a movable axis.

A third link 64 has first and second opposing ends 66, 68, respectively. The third link 64 preferably includes a threaded length 69 between the first and second ends 66, 68. Nuts 69*a*, 69*b* are threaded onto the length 69 and tightened against the first and second opposing ends 66, 68, respectively. The threaded length 69 allows the overall length of the third link 64 to be adjustable. However, the third link 64 can be a solid, non-adjustable link. The first end 66 of the third link 64 is pivotally connected to the second end 52 of the first link 48 and the first end 58 of the second link 56 at the second pivot 62. The second pivot 62 comprises a movable axis.

A fourth link 70 has first and second opposing ends 72, 74, respectively. The first end 72 of the fourth link 70 is pivotally connected to the second end 68 of the third link 64 at a fourth pivot 76. The fourth pivot 76 comprises a movable axis. The second jaw 20 and the second end 74 of the fourth link 70 are pivotally connected along a common, immovable axis at a fifth pivot 77 preferably fixed with respect to the first jaw 18. The fourth link 70 includes a cutout 78 located therein for reasons that will be hereinafter explained. The linkage assembly 16 transmits power from the electric motor 27 to close the first and second jaws 18, 20 for cutting, more specifically, to close the cutting blade 82 of the second jaw 20 against (solid in FIG. 2) and past (phantom in FIG. 2) the cutting blade 36 of the first jaw 18.

The first link 48, the second link 56, the third link 64, and the fourth link 70 are all located on a first major side of the ratchet tool 10 as shown in FIG. 1. Those skilled in the art will realize that the first link 48, the second link 56, the third link 64, and the fourth link 70 can be located on the opposing major side of the ratchet tool 10 as well. As shown in FIG. 2, a second linkage assembly 16*a*, which is preferably generally a mirror image of the linkage assembly 16, is preferably mounted on the opposing major side of the ratchet tool 10. The second linkage assembly 16*a* comprises a fifth link 48*a* a which is preferably a mirror image of the first link 48, a sixth link 56*a* which is preferably a mirror image of the second link 56, preferably the third link 64 itself, and a seventh link 70*a* which is preferably a mirror image of the fourth link 70, but without the cutout 78. The fifth link 48*a*, the sixth link 56*a*, and the seventh link 70*a* are connected to the same pivots as and move with their counterpart first, second and fourth links 48, 56, and 70, respectively. The second linkage assembly 16*a* aids in evenly transmitting power from the electric motor 27 to the first and second jaws 18, 20. The third link 64, the eccentric 46, and the first, second, third, fourth, and fifth pivots 54, 62, 63, 76, and 77, respectively, are common to both the linkage assemblies 16, 16*a* on the two major sides of the ratchet tool 10, as shown in FIGS. 1 and 2. In FIG. 2, the eccentric 46 is shown in an extreme lower position which, for convenience, will be referred to hereafter as a six o'clock position, and the second linkage assembly 16*a* is positioned accordingly.

Preferably, the first jaw 18, the second jaw 20, all of the links 48, 48*a*, 56, 56*a*, 64, 70, and 70*a*, the first handle 22, the second handle (if used), the output shaft 28, the electric motor 27 and the frame 12 are all elongated and lay in parallel planes.

Although the remainder of this disclosure will generally discuss the configuration and operation of the ratchet tool 10 utilizing language describing only the members making up the linkage assembly 16, those skilled in the art will realize that the same description pertains to the corresponding members making up the second linkage assembly 16*a* as well.

Figure 3:
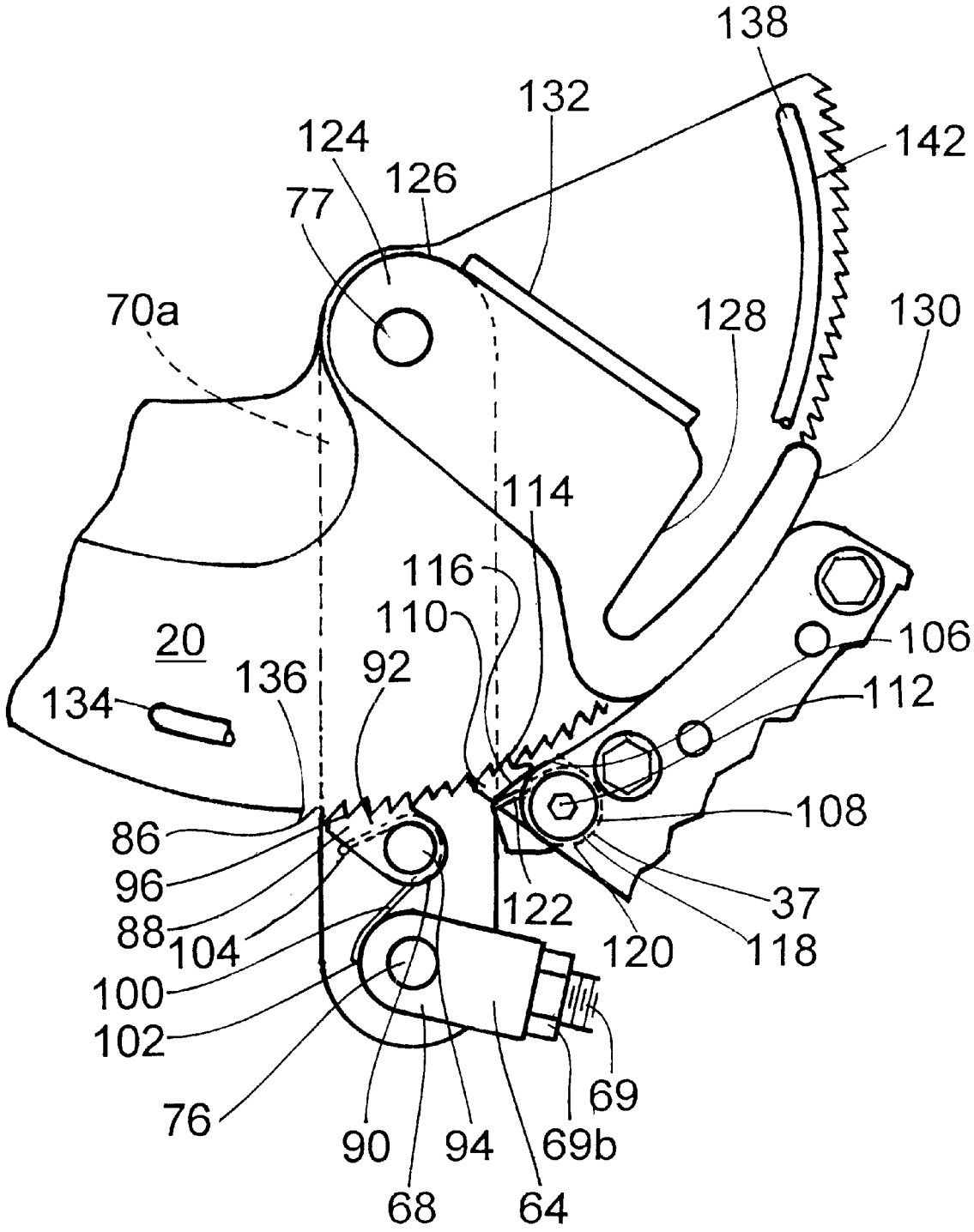
FIG. 3 is an enlarged view, partially cut away, of a portion of the one major side of the motorized hand-held ratchet tool according to the first embodiment of the present invention showing the selector lever disengaged from the first and second pawls.
Figure 4:
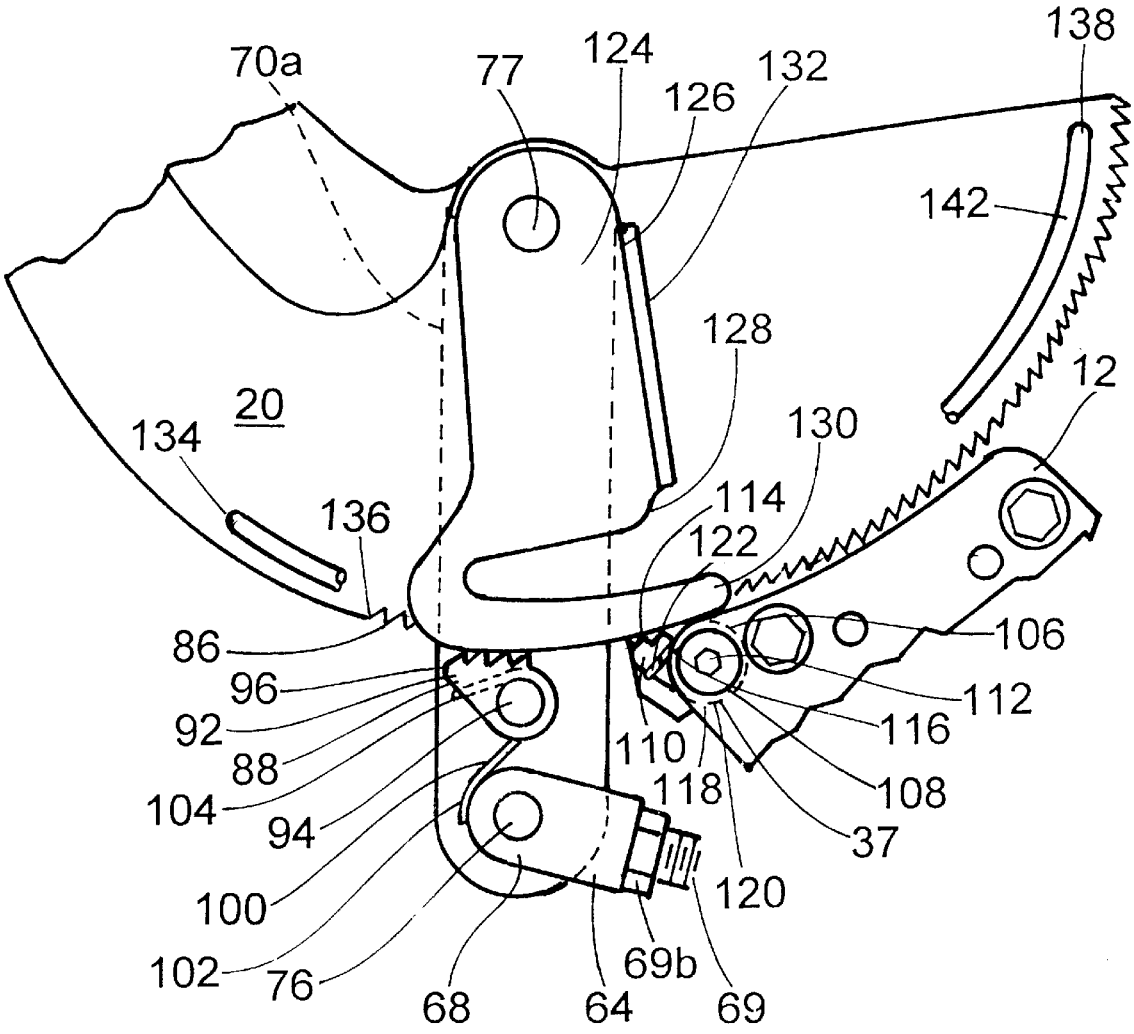
FIG. 4 is an enlarged view, partially cut away, of a portion of the opposing major side of the motorized hand-held ratchet tool according to the first embodiment of the present invention showing the selector lever engaged with the first and second pawls.

As shown in FIGS. 3–4, the first pawl 88 has a first end 90 and a second end 92. The first end 90 is pivotally mounted to and between the fourth and seventh links 70, 70*a* between the first end 72 and the second end 74 of those links 70, 70*a* at a sixth pivot 94. Referring specifically to FIG. 3, the second end 92 of the first pawl 88 includes a plurality of ratchet teeth 96, which are cut so as to be engageable with the ratchet teeth 86 of the second jaw 20 in a clockwise direction in FIGS. 1, 3 and 4 and to be able to drive the ratchet teeth 86 and the working face of the second jaw 20 towards that of the first jaw 18. A first torsional spring 100 is wrapped around a pin or the like defining the sixth pivot 94. A first end 102 of the first torsional spring 100 contacts the second end 68 of the third link 64, and a second end 104 of the spring 100 wraps around the first pawl 88 so as to bias the second end 92 of the first pawl 88 toward the ratchet teeth 86 of the second jaw 20.

The linkage assemblies 16, 16*a* are configured to convert rotary drive motion from the drive mechanism 26 into oscillatory motion of the fourth and seventh links 70, 70*a* along opposite sides of the second jaw 20 and of the first pawl 88 along the ratchet teeth 86 of the second jaw 20. The first pawl 88 is drivingly connected to the second link 56 through the third and fourth links, 64, 70, respectively, to rotate the working face of the second jaw 20 towards that of the first jaw 18 to close the second jaw 20 in a closing direction (clockwise in FIGS. 1, 3, and 4) with respect to the first jaw 18 during the oscillatory motion when the drive mechanism 26 is operated.

Referring back to FIG. 3, a second pawl 106 is preferably provided, having a first end 108 and a second end 110. The second pawl 106 is located in a space between and is coupled to the tang 37 of the frame 12 and to the first jaw 18 at a seventh pivot 112. The second end 110 of the second pawl 106 includes a plurality of ratchet teeth 114, which are cut so as to be engageable with the ratchet teeth 86 of the second jaw 20 and to prevent the second jaw 20 from being driven in an opening direction with respect to the first jaw 18 (counter-clockwise in FIGS. 1, 3, and 4), opposite the closing direction, as the first pawl 88 moves over successive ratchet teeth 86 of the second jaw 20. The second end 110 of the second pawl 106 further includes a lip 116. A second torsional spring 118 is wrapped around a pin defining the seventh pivot 112. A first end 120 of the second torsional spring 118 contacts the frame 12, and a second end 122 of the second torsional spring 118 contacts and engages the lip 116 on the second end 110 of the second pawl 106. The second torsional spring 118 biases the second end 110 of the second pawl 106 toward the ratchet teeth 86 of the second jaw 20. Those skilled in the art will realize that the first pawl 88 can include a lip similar to the lip 116 on the second pawl 106 and the second end 104 of the first torsional spring 100 can contact the lip, or the lip 116 on the second pawl 106 can be eliminated and the second end 122 of the second torsional spring 118 can wrap around a front end of the second pawl 106. Referring to FIGS. 1, 3, and 4, a selector lever 124 has a first end 126 and a second end 128. The first end 126 of the selector lever 124 is pivotally attached to a pin defining the fifth pivot 77. The second end 128 of the selector lever 124 includes a selector leg 130 which extends generally along an arc traced by the second end 128 of the selector lever 124 as it pivots about the fifth pivot 77. The selector leg 130 is operatively associated with the first and second pawls 88, 106 to selectively bias the first and second pawls 88, 106 out of engagement with the ratchet teeth 86 of the second jaw 20. A selector engagement arm 132 extends generally perpendicularly from the selector lever 124. The selector engagement arm 132 allows the operator to selectively pivot the selector lever 124 between a first position, shown in FIG. 3, in which the selector leg 130 is disengaged from the first and second pawls 88, 106, thus allowing the first and second pawls 88, 106 to engage the ratchet teeth 86 of the second jaw 20, and a second position, shown in FIG. 4, in which the selector leg 130 is engaged with the first and second pawls 88, 106, thus biasing the first and second pawls 88, 106 out of engagement with the ratchet teeth 86 of the second jaw 20. When the first and second pawls 88, 106 are out of engagement with the ratchet teeth 86 of the second jaw 20, the second jaw 20 is free to rotate on the fifth pivot 77 in either of the opening and closing directions.

Referring back to FIG. 1, a first inhibitor or stop 134 is mounted on the second jaw 20 generally proximate to a first end 136 of the ratchet teeth 86 on the second jaw 20. A second inhibitor or stop 138 is mounted on the second jaw 20 generally proximate to a second end 140 of the ratchet teeth 86 on the second jaw 20. The first and second inhibitors 134, 138 extend outward from the second jaw 20 sufficiently to be engageable with the fourth link 70 so as to limit the relative movement of the second jaw 20 with respect to the first jaw 18. The cutout 78 is located on the fourth link 70 to receive the second inhibitor 138 when the second jaw 20 is rotated to a fully closed position. The second inhibitor 138 should be located on the second jaw 20 in order to drive the selector lever 124 to disengage the second pawl 106 from the ratchet teeth 86 prior to the second inhibitor 138 reaching the cutout 78. If the inhibitors 134, 138 are both located on the second jaw 20, a bar 142 can extend outwardly from and connect the inhibitors 134 and 138, forming a handle to more easily rotate the second jaw 20 relative to the first jaw 18. If the bar 142 is used, the second handle can be eliminated, and the bar 142 can be used as a second handle.

Preferably, the load bearing portions of the frame 12 are made from a metal, such as carbon steel, although those skilled in the art will realize that the frame 12 can be made from other suitable materials. More preferably, all of the load bearing, driving/driven components of the tool from the motor output shaft through the jaws 18, 20 are also made from heat treated carbon steel. The jaws 18, 20 are also heat treated steel, and are treated to a hardness of a Rockwell C ($R_C$) of 49–54.

Preferably, a cover (not shown) can be installed at least partially over the linkage assemblies 16, 16*a*, the gear set 38, the eccentric 46, and the first and second pawls 88, 106 to protect the operator from injury during operation of the hand-held ratchet tool 10.

Operation of the hand-held ratchet tool 10 will now be described. If the ratchet tool 10 is powered by 110 mvolt alternating current, an electrical cord on the tool must be plugged into a power source. Alternately, if the ratchet tool 10 is battery powered, a charged power supply must be inserted into the ratchet tool 10. If not already open, the operator disengages the pawls 88, 106 with the selector lever 124 and rotates the second jaw 20 to separate the cutting blades 36, 82. The operator then places a cable (not shown) or other item to be cut between the open first and second jaws 18, 20.

Holding the tool 12, the operator squeezes the trigger 24, energizing the electric motor 27. The electric motor 27 rotates the output shaft 28, which in turn rotates the bevel pinion 40 about the output shaft 28. It is immaterial in which direction the bevel pinion 40 rotates. The bevel pinion 40 rotates the engaged bevel gear 42 about its axis 43. As the bevel gear 42 rotates, the eccentric 46 rotates about the bevel gear axis 43 in a circle from the twelve o'clock position shown in FIG. 1 to the six o'clock position shown in FIG. 2, and back to the twelve o'clock position shown in FIG. 1. The eccentric 46 carries the second end 60 of the second link 56 about the third pivot 63. As the second end 60 of the second link 56 is driven by the eccentric 46, the first end 58 of the second link 56, the second end 52 of the first link 48, the first end 66 of the third link 64, and the movable second pivot 62 all oscillate in a counter-clockwise direction around the first pivot 54 from the position shown in FIG. 1 to the position shown in FIG. 2 and then in a clockwise direction back to the position shown in FIG. 1 through an arc having a radius defined by the length of the first link 48 between the first pivot 54 and the second pivot 62. Movement of the first end 66 of the third link 64 oscillates the second end 68 of the third link 64, the first end 72 of the fourth link 70, and the fourth pivot 76 in the clockwise direction from the position shown in FIG. 1 to the position shown in FIG. 2 and then in the counter-clockwise direction back to the position shown in FIG. 1 about the fifth pivot 77 through an arc defined by the length of fourth link 70 between the fourth pivot 76 and the fifth pivot 77.

As the first end 72 of the fourth link 70 oscillates in the clockwise direction from the location shown in FIG. 1 (i.e. as the eccentric 46 rotates from the twelve o'clock position to the six o'clock position), the ratchet teeth 96 of the first pawl 88, which are engaged with the ratchet teeth 86 of the second jaw 20, are driven in the clockwise direction from the position shown in FIG. 1 to the position shown in FIG. 2. The ratchet teeth of the first pawl 88 are driven in the clockwise direction and drive the ratchet teeth 86 of the second jaw 20 also in the clockwise direction from the position shown in FIG. 1, pivoting the second jaw 20 about the fifth pivot 77, towards the position shown in FIG. 2, closing together the working faces of the first and second jaws 18, 20, which proceed to cut the cable (not shown) or whatever item is being cut. As the second jaw 20 is driven in the clockwise direction by the first pawl 88, the teeth 86 of the second jaw 20 ratchet over the teeth 114 of the second pawl 106.

As the eccentric 46 is rotated from the six o'clock position to the twelve o'clock position, the linkage assembly 16 and the first pawl 88 return to their original positions as shown in FIG. 1. As the first pawl 88 returns to its original position, the teeth 96 of the first pawl 88 ratchet in the counter-clockwise direction (as seen in FIGS. 1, 3, and 4) over the teeth 86 of the second jaw 20. The ratchet teeth 114 of the second pawl 106 remain engaged with the ratchet teeth 86 of the second jaw 20, preventing the second jaw 20 from rotating in the counter-clockwise direction as the first pawl 88 returns to its original (twelve o'clock) position. The process is repeated for each revolution of the eccentric 46 about the bevel gear axis 43. Preferably the second jaw 20 advances two ratchet teeth 86 over the first pawl 88 for each revolution of the eccentric 46 about the bevel gear axis 43. However, those skilled in the art will realize that, for each revolution of the eccentric 46, more or less than two ratchet teeth 86 of the second jaw 20 can advance over the first pawl 88.

Still referring to FIG. 1, as the second jaw 20 closes, the second jaw 20 pivots about the fifth pivot 77 until the second inhibitor 138 on the second jaw 20 contacts the selector lever 124. Preferably, the second inhibitor 138 contacts the selector lever 124 at the second end 128 of the selector lever 124 where the leg 130 extends from the second end 128 of the selector lever 124. However, those skilled in the art will realize that the inhibitor 138 can contact the selector lever 124 at any location along its length. As the second jaw 20 continues to close, the inhibitor 138 continues to travel in the same (clockwise direction in FIG. 1) with the second jaw 20, driving the selector lever 124 in the same (clockwise) direction with the inhibitor 138. The inhibitor 138 and the selector lever 124 travel together until the inhibitor 138 contacts the fourth link 70 inside the cutout 78. As the selector lever 124 is moved with the inhibitor 138, the selector leg 130 moves to engage the second pawl 106, biasing the second pawl 106 away from the second jaw 20, and disengaging the second pawl 106 from the second jaw 20. The first jaw 18 and the second jaw 20 have fully closed by this time, and no further cutting is possible. However, if the operator continues to press the trigger 24 in this condition, the electric motor 27 will continue to rotate and the linkage assembly 16 will still oscillate. As the fourth link 70 travels in the opposite (counter-clockwise) direction from the position shown in FIG. 2 (as indicated by the position of the seventh link 70*a*) to the position shown in FIG. 1, the fourth link 70 will move the inhibitor 138, and thus, the second jaw 20, also in the counter-clockwise direction. During normal operation, the engagement of the second pawl 106 with the second jaw 20 would prevent rotation of the second jaw 20 in the counterclockwise direction and continued operation of the electric motor 27 by the operator would likely burn out the electric motor 27 or otherwise damage the ratchet tool 10. However, since the inhibitor 138 has moved the selector lever 124 to disengage the second pawl 106 from the second jaw 20, the second jaw 20 is free to rotate in the counter-clockwise direction with the fourth link 70, preventing damage to the electric motor 27 and the ratchet tool 10.

After the first and second jaws 18, 20 have fully closed, the operator releases the trigger 24, stopping the electric motor 27. The operator must fully engage the selector lever 124 with the first and second pawls 88, 106 by manually moving the selector engagement arm 132 clockwise, or, to the left in FIG. 1. When the selector leg 130 is fully rotated, the selector leg 130 biases the first and second pawls 88, 106 from the second jaw 20, releasing the ratchet teeth 96, 114 of the first and second pawls 88, 106, respectively, from engagement with the ratchet teeth 86 of the second jaw 20. The operator then rotates the second jaw 20 relative to the first jaw 18 in an opposite direction, opening the first and second jaws 18, 20. Preferably, the operator opens the first and second jaws 18, 20 by grasping the bar 142 and rotating the second jaw 20 with respect to the first jaw 18 until the first inhibitor 134 contacts the fourth link 70, or until the first and second jaws 18, 20 are sufficiently opened for the operator. However, those skilled in the art will realize that other methods may be employed to open the first and second jaws 18, 20. The selector leg 130 is disengaged from the first and second pawls 88, 106 by grasping the selector engagement arm 132 and moving the selector engagement arm 132 counter-clockwise (in FIG. 1), allowing the first spring 100 to bias the first pawl 88 and the second spring 118 to bias the second pawl 106, respectively, into engagement with the ratchet teeth 86 of the second jaw 20. The ratchet tool 10 is again ready for cutting.

In order to fully realize the power of the drive mechanism 26, it is important that the second pawl 106 just engages a tooth 86 on the second jaw 20 at the point where the first pawl 88 reverses. This feature minimizes "spring back" and maximizes movement of the second jaw 20 relative to the first jaw 18 for a given power requirement. As the cutting tool 10 is used, wear in all parts affects the timing between the first pawl 88 and the second pawl 106. The adjustability of the third link 64 allows for adjustment of the position of the first pawl 88 with respect to the second pawl 106. Additionally, the timing between the first pawl 88 and the second pawl 106 remains identical for similar jaws 18, 20 cutting similarly constructed materials. However, if blade shape and/or size is altered, especially to optimize cutting an altered cable construction, the timing, due to different loads, may change. Thus, the adjustability of the third link 64 allows the same drive mechanism 26 to be used for all blade shapes and/or cutting arrangements.

Figure 5:
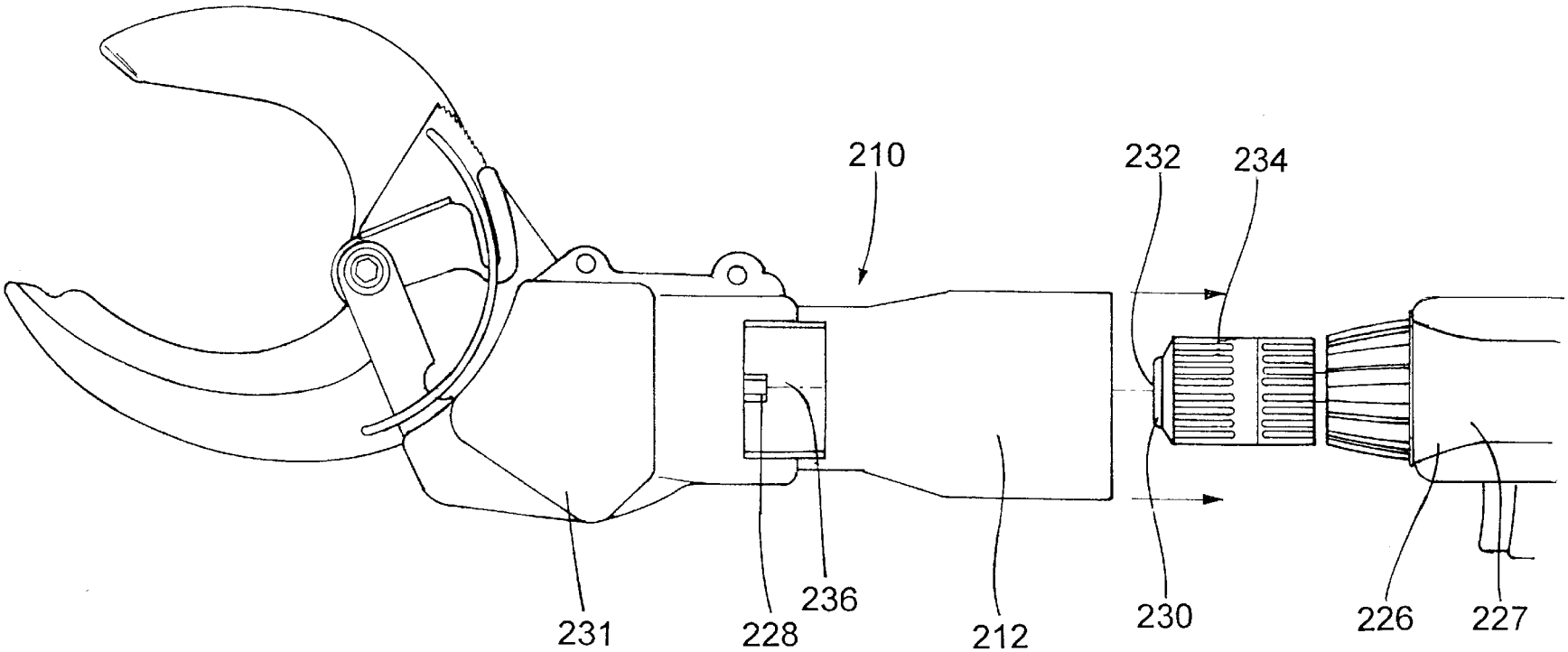
FIG. 5 is an elevational view of a major side of a hand-held ratchet tool according to a second embodiment of the present invention.

In a second embodiment, shown in FIG. 5, a ratchet action tool 210 is separate from a motorized drive mechanism 226, which includes at least a standard hand-held electric drill 227. The tool 210 includes a frame 212 which can be inserted over the drive end 230 of the drill 227. An output shaft 228 which extends from and is at least partially surrounded by the frame 212 is inserted into the jaws of a chuck 232 of the drill 227 as the frame 212 is inserted over the drive end 230 of the drill 227. Although encased by a protective cover 231, the tool 210 incorporates all of the elements of the tool 10 downstream from the motorized drive mechanism 26 including the first jaw 18 and the second jaw 20 with the plurality of ratchet teeth 86, and the second jaw 20 being mounted to pivot with respect to the first jaw 18. The tool 210 also includes the linkage 16 of at least the four links 48, 56, 64, 70 (and preferably links 48*a*, 56*a* and 70*a*) operatively coupled together and with the first and second jaws 18, 20 and the first pawl 88. The linkage 16 is configured to operate in the same way as in the first embodiment, driving the first pawl 88 in oscillatory motion along the ratchet teeth 86, and the first pawl 86 is arranged to drive the second jaw 20 towards the first jaw 18 during the oscillatory motion. The output shaft 228 is operatively coupled to the linkage 16 through a gear set (not shown) on the tool 210 in the same manner that the output shaft 28 is operatively connected to the bevel pinion 40 of gear set 38 in the first embodiment of the tool 10. An opening 236 in the frame 212 allows a collar 234 of the chuck 232 on the drill 227 to be tightened by a chuck key (not shown) or, in a keyless drill (shown in FIG. 5), by rotating the collar 234 relative to the drill 227, tightening the jaws of the chuck 232 around the output shaft 228, and securing the tool 210 to the drill 227.

The operation of the tool 210 will now be described. The tool 210 must first be drivingly connected to the drill 227. To do so, the frame 212 is inserted over the drive end 230 of the drill 227. The output shaft 228 is inserted into the chuck 232 of the drill 227. The chuck 232 is then tightened around the output shaft 228 by rotating the chuck collar 234 in a locking direction, drivingly connecting the output shaft 228 to the drive end 230 of the drill 227. The tool 210 is now ready for operation. The drill 227 is operated in the known manner, which rotates the chuck 232 during operation. As the chuck 232 rotates, the output shaft 228 rotates as well, operating the tool 210 in a manner similar to the operation of the tool 10 as described above.

Although the present invention shows the specific linkage assemblies 16, 16*a*, described above, those skilled in the art will realize that other combinations and numbers of links forming different linkage assemblies will also provide satisfactory results although under less demanding conditions than can be met by the preferred design. Although the preferred shape of the cutting blades 36, 84 is shown, those skilled in the art will realize that blades having other shapes can be used as well. Additionally, although the jaws 18, 20 are located to scissor with respect to each other, those skilled in the art will realize that the jaws 18, 20 can be arranged so that one jaw can incorporate a blade (or other shape) and the other jaw can incorporate an anvil or cutting surface, such that, as the jaws are closed, the blade or other working surface of the one jaw impacts the anvil or cutting surface or other working surface of the other jaw, severing or gripping or compressing an item located between the two jaws.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

What is claimed is:

1. A hand-held ratchet action tool comprising:

a frame;

an elongate handle being fixed with the frame;

a first jaw being mounted to the frame;

a first link having first and second opposing ends, the first end of the first link being pivotally coupled to the frame;

a second link having first and second opposing ends;

a third link having first and second opposing ends, the first end of the third link, the second end of the first link and the first end of the second link all being pivotally connected along a common, movable pivot axis;

a fourth link having first and second opposing ends, the first end of the fourth link being pivotally coupled to the second end of the third link;

a second jaw including a plurality of ratchet teeth for receiving a first pawl, the second end of the fourth link and the second jaw being pivotally connected along a common, immovable axis fixed with respect to the first jaw;

a first pawl being pivotally mounted on the fourth link between the first and second ends of the fourth link, so as to be engageable with the ratchet teeth of the second jaw;

a motorized drive mechanism attached to the frame, the motorized drive mechanism having an output;

a gear set having an input and an output, the motorized drive mechanism output being drivingly connected to the gear set input;

an eccentric drivingly connected to the gear set output, the eccentric pivotally supporting the second end of the second link, the second link being drivingly connected to the first pawl so as to close the second jaw in a first direction with respect to the first jaw when the motorized drive mechanism is operated;

a second pawl mounted on the frame so as to engage the ratchet teeth of the second jaw to prevent the second jaw from being driven in a second direction opposite the first direction when the first pawl is disengaged from the ratchet teeth;

a selector operatively associated with the first and second pawls to selectively bias the first and second pawls out of engagement with the ratchet teeth of the second jaw; and at least one inhibitor mounted on at least one of the first and second jaws so as to limit the relative movement of the second jaw with respect to the first jaw.

2. A hand-held ratchet action tool comprising:

a first jaw;

a second jaw including a plurality of ratchet teeth, the second jaw being mounted to pivot with respect to the first jaw;

a linkage of four links operatively coupled together and with the first and second jaws;

a first pawl supported on one of the four links so as to be engageable with the ratchet teeth of the second jaw; and a drive mechanism;

wherein the linkage comprises:

a first link having first and second opposing ends, the first end being mounted on a pivot located at a fixed position with respect to the first jaw;

a second link having first and second opposing ends, the drive mechanism being operatively connected to the second end of the second link;

a third link having first and second opposing ends, the first end of the third link, the second end of the first link and the first end of the second link all being pivotally connected along a common pivot axis; and a fourth link having first and second opposing ends, the first end of the fourth link being pivotally coupled to the second end of the third link; and wherein the linkage is configured to drive the first pawl in oscillatory motion along the ratchet teeth, and the first pawl is arranged to drive the second jaw towards the first jaw in a first direction during the oscillatory motion.

3. The hand-held ratchet action tool of claim 2 wherein the first end of the first link is mounted to pivot on an axis fixed with respect to the first jaw; and wherein the second end of the fourth link and the second jaw are mounted to separately pivot on a common axis fixed with respect to the first jaw.

4. The hand-held ratchet action tool according to claim 2, further comprising a second pawl coupled with the first jaw so as to engage the ratchet teeth of the second jaw to prevent the second jaw from being driven in a second direction with respect to the first jaw opposite the first direction as the first pawl moves over successive ratchet teeth of the second jaw.

5. The hand-held ratchet action tool according to claim 4, further comprising a selector operatively associated with the first and second pawls to selectively bias the first and second pawls out of contact with the ratchet teeth of the second jaw.

6. The hand-held ratchet action tool according to claim 5, wherein the second jaw is free to rotate on a common, pivot axis in either of the first and second directions when a first and second pawls are out of engagement with the ratchet teeth of the second jaw.

7. The hand-held ratchet action tool according to claim 2, wherein the first and second jaws have opposed cutting blades located to scissor side by side.

8. The hand-held ratchet action tool according to claim 2, further comprising at least one inhibitor mounted on at least one of the first and second jaws, the at least one inhibitor limiting the relative movement of the second jaw with respect to the first jaw.

9. The hand-held ratchet action tool according to claim 2 further including a drive mechanism operatively coupled with the linkage, the linkage converting drive motion from the drive mechanism into oscillatory motion of the first pawl along the ratchet teeth, and the first pawl being arranged to drive the second jaw towards the first jaw during the oscillatory motion.

10. The hand-held ratchet action tool according to claim 9, further comprising a first handle fixedly attached to the first jaw and an elongated drive member of the drive mechanism and wherein the first jaw, the second jaw, the four links, the handle, and the elongated drive member of the drive mechanism all lay in parallel planes.

11. The hand-held ratchet action tool according to claim 9, wherein the drive mechanism is operatively connected to the second jaw through the linkage and first pawl so as to close the first and second jaws.

12. A hand-held ratchet action tool comprising:

a first jaw;

a second jaw including a plurality of ratchet teeth, the second jaw being mounted to pivot with respect to the first jaw;

a linkage of four links operatively coupled together and with the first and second jaws;

a first pawl supported on one of the four links so as to be engageable with the ratchet teeth of the second jaw; and a drive mechanism operatively coupled with the linkage;

the linkage being configured to drive the first pawl in oscillatory motion along the ratchet teeth, and the first pawl being arranged to drive the second jaw towards the first jaw during the oscillatory motion;

the linkage converting drive motion from the drive mechanism into oscillatory motion of the first pawl along the ratchet teeth, and the first pawl being arranged to drive the second jaw towards the first jaw during the oscillatory motion; and the drive mechanism further comprises a gear set, the gear set having an output pivotally attached to one end of one of the links.

13. The hand-held ratchet action tool according to claim 12, wherein the gear set comprises a bevel gear and bevel pinion.

14. The hand-held ratchet action tool according to claim 13, wherein the drive mechanism further comprises an eccentric attached to the gear set output, the eccentric being pivotally attached to the one end of the one link.

15. The hand-held ratchet action tool according to claim 12 wherein the drive mechanism further comprises a hand-operated drill drive.

16. The hand-held ratchet action tool according to claim 12 wherein the drive mechanism is other than manually powered.

17. A hand-held ratchet action tool comprising:

a first jaw;

a second jaw including a plurality of ratchet teeth, the second jaw being mounted to pivot with respect to the first jaw;

a linkage of four links operatively coupled together and with the first and second jaws;

a pawl supported on one of the four links so as to be engageable with the ratchet teeth of the second jaw; and the linkage being configured to drive the pawl in oscillatory motion along the ratchet teeth, and the pawl being arranged to drive the second jaw towards the first jaw during the oscillatory motion;

a drive mechanism operatively coupled with the linkage, the linkage converting drive motion from the drive mechanism into oscillatory motion of the pawl along the ratchet teeth, the drive mechanism being operatively connected to the second jaw through the linkage and the pawl so as to close the first and second jaws; and the drive mechanism comprises an electric motor.

18. The hand-held ratchet action tool according to claim 17, wherein the drive mechanism further comprises a gear set having an output pivotally attached to one end of the one link.

* * * * *